US006530851B2

(12) United States Patent
Munster

(10) Patent No.: US 6,530,851 B2
(45) Date of Patent: Mar. 11, 2003

(54) BALL RACKET WITH DAMPED TWO PART PROFILE

(75) Inventor: Udo Munster, Baar (CH)

(73) Assignee: Volkl Tennis GmbH, Baar (CH)

( * ) Notice: Subject to any disclaimer, the term of this patent is extended or adjusted under 35 U.S.C. 154(b) by 0 days.

(21) Appl. No.: 09/804,192

(22) Filed: Mar. 13, 2001

(65) Prior Publication Data

US 2001/0023210 A1 Sep. 20, 2001

(30) Foreign Application Priority Data

| | | |
|---|---|---|
| Mar. 16, 2000 | (DE) | 100 12 733 |
| Jul. 27, 2000 | (DE) | 100 37 043 |
| Aug. 18, 2000 | (DE) | 100 40 367 |
| Dec. 16, 2000 | (DE) | 100 62 883 |

(51) Int. Cl.[7] ..... A63B 51/00

(52) U.S. Cl. ..... 473/521; 473/539; 473/548; 473/534

(58) Field of Search ..... 473/520, 521, 473/522, 524, 539, 540, 548, 534

(56) References Cited

U.S. PATENT DOCUMENTS

| | | | | | |
|---|---|---|---|---|---|
| 360,468 | A | * | 4/1887 | Phelps | 473/534 |
| 1,542,177 | A | * | 6/1925 | Rose | 473/540 |
| 3,884,467 | A | * | 5/1975 | Sommer | 473/539 |
| 4,772,021 | A | * | 9/1988 | Maynard | 473/521 |
| 5,102,132 | A | * | 4/1992 | Chen | 473/519 |
| 5,165,687 | A | * | 11/1992 | Soong | 473/521 |
| 5,368,297 | A | * | 11/1994 | Liu | 473/539 |
| 5,458,331 | A | * | 10/1995 | Bothwell | 473/534 |
| 5,762,570 | A | * | 6/1998 | Shaw | 473/522 |
| 5,944,625 | A | * | 8/1999 | Janes | 473/539 |

FOREIGN PATENT DOCUMENTS

| | | | |
|---|---|---|---|
| DE | 3432422 | * | 3/1986 |
| DE | 3806038 | * | 9/1989 |
| DE | 4104988 | * | 8/1992 |
| GB | 320183 | * | 10/1929 |
| WO | 90/02584 | * | 3/1990 |

* cited by examiner

*Primary Examiner*—Raleigh W. Chiu
(74) *Attorney, Agent, or Firm*—Hoffman, Wasson & Gitler PC

(57) ABSTRACT

This invention refers to a novel ballgame racket, especially a tennis racket, including a racket head formed by a tension frame with stringing, and also having a grip portion joining the tension frame, for example by means of a crossing and formed by a gripping shaft or a racket neck and a handle. The racket has a mechanism for tensioning the strings which includes a two part tension frame of the racket head. The frame has a closed hollow profile with a second wing like profile in touch with the closed profile with a damping element placed therebetween.

19 Claims, 6 Drawing Sheets

FIG. 4
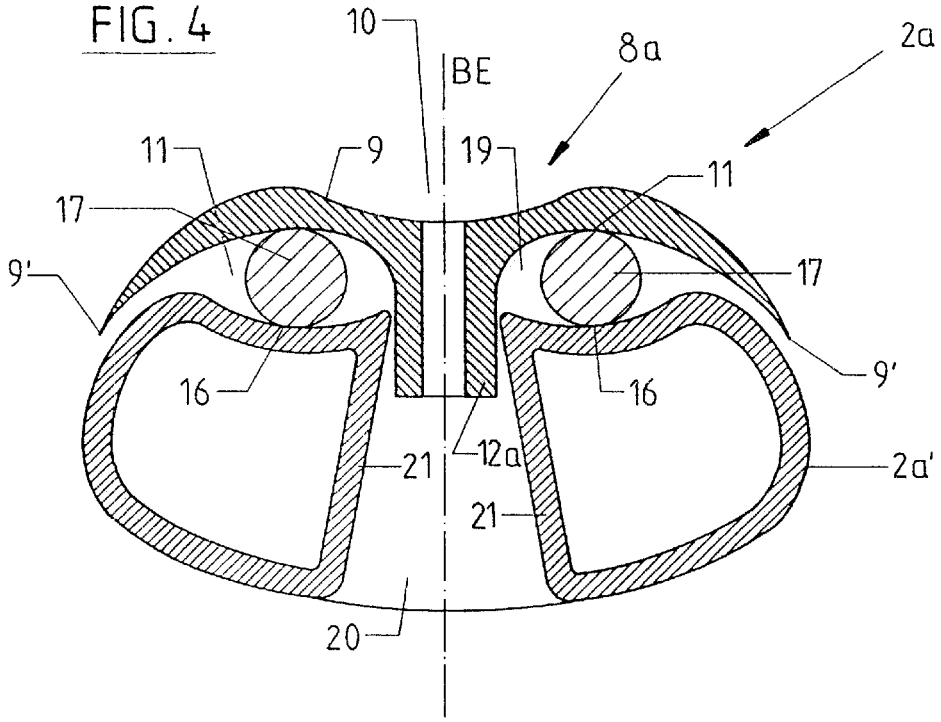
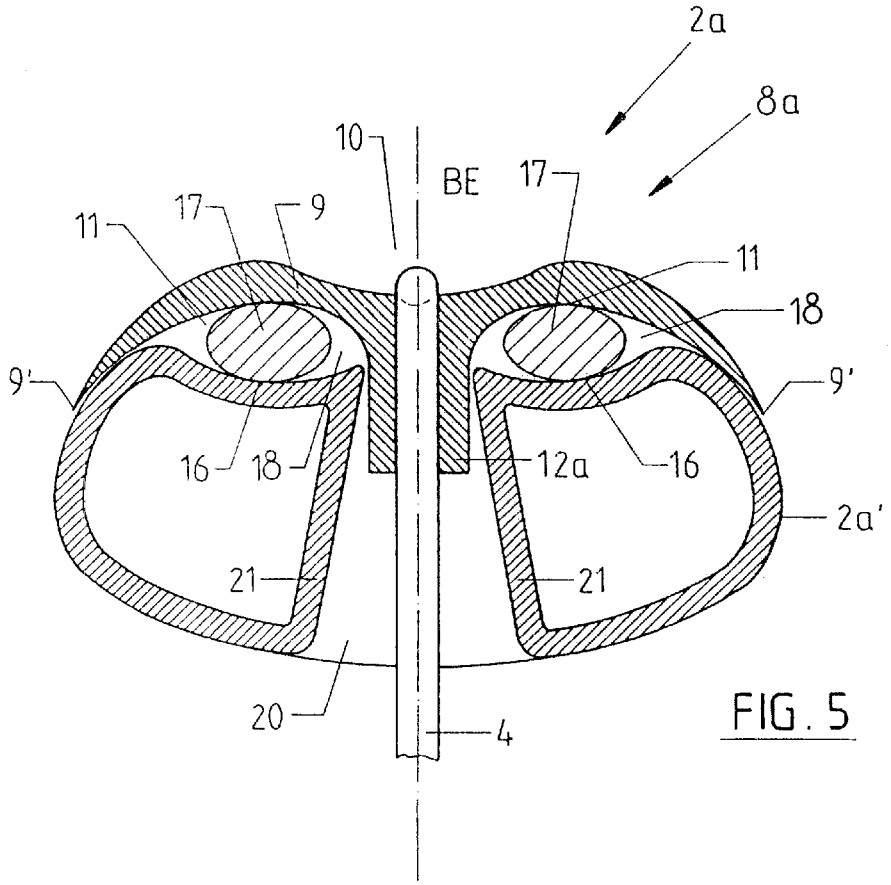
FIG. 5

BALL RACKET WITH DAMPED TWO PART PROFILE

BACKGROUND OF THE INVENTION

The present invention pertains to a ball racket, and more particularly, a tennis racket having a handle, a tension frame and stringing. The racket has a core and handle shaft connecting the handle to the tension frame. The tension frame has a profile for holding the strings in tension with a dampening mechanism for causing string tension A ball racket (U.S. Pat No. 5,458,331) is already known with a tension frame forming the racket head that is of a two-part design, with an inner frame profile adjacent to the stringing and an outer frame profile in relation to the stringing on which the eyelets for fastening the strings forming the stringing are located. Both profiles overlap in such a manner that they form two chambers of variable volume extending along the tension frame between the two profiles on both sides from one plane of the stringing (stringing plane), which (chambers) are sealed toward the outside and can be pressurized by means of a valve with a fluid that is under pressure, for example with pressurized $CO_2$ gas. The purpose of this is to achieve the best possible tension.

The object of the present invention is to provide a ball racket, in particular a tennis racket, with improved playing properties.

SUMMARY OF THE INVENTION

To achieve this object, a ball racket with a racket head formed by a tension frame with stringing and by a handle element connecting to the tension frame is provided. The tension frame contains two parts in at least one portion of the racket head and has a tension frame profile adjacent to the stringing for holding the strings. The tension string profile holds the strings in a tensioned or dampened state.

BRIEF DESCRIPTION OF THE FIGURES

The invention is described in more detail based on sample embodiments in the following figures:

FIGS. 4 and 5 are representations similar to FIGS. 2 and 3, in an alternate embodiment of the invention;

DETAILED DESCRIPTION OF THE INVENTION

Figure 1:
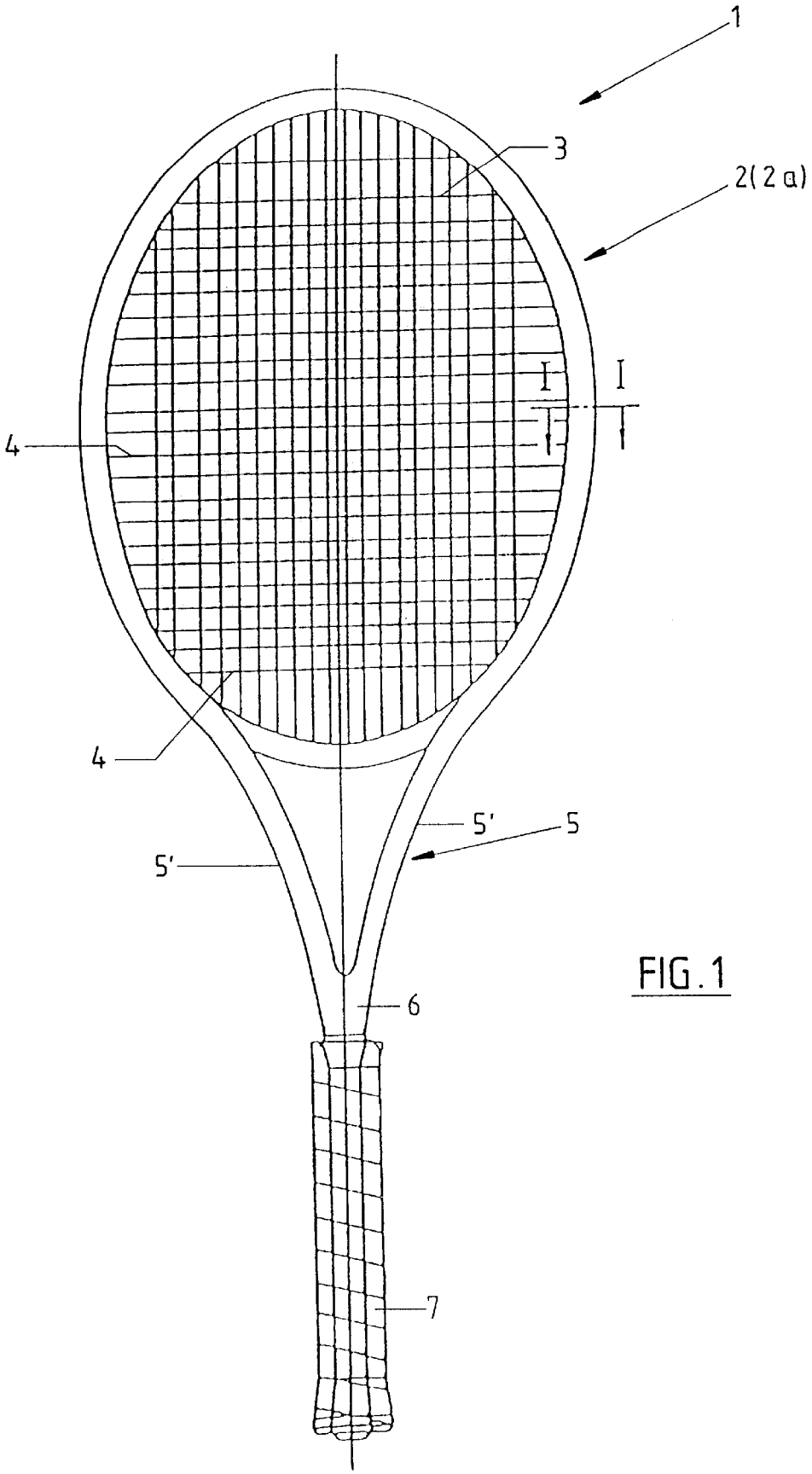
FIG. 1 is a simplified representation in top view of a ball racket according to the invention in the form of a tennis racket.

The tennis racket depicted in the figures and generally designated 1 is made up of: a tension frame 2 forming the racket head and having the stringing 3 located there, which is made up of numerous sections of string or strings 4 that cross each other; and of the racket neck or racket grip shaft 6 connected to the tension frame 2 or its tension frame profile 2' or **2*a'* (FIGS. 2–5) above a core 5, to which (shaft) the racket handle 7 is located. The tension frame profile 2' or 2*a'*, the core 5, which is formed by two bars or arms 5' extending and diverging from the handle shaft 6. The handle shaft 6** and core form a one-piece racket frame, which in the depicted embodiment is manufactured as a hollow body or hollow frame that is closed toward the outside and made of a suitable material, such as fiber-reinforced plastic material and has a hollow profile that is closed to the outside along its entire length.

Figure 2:
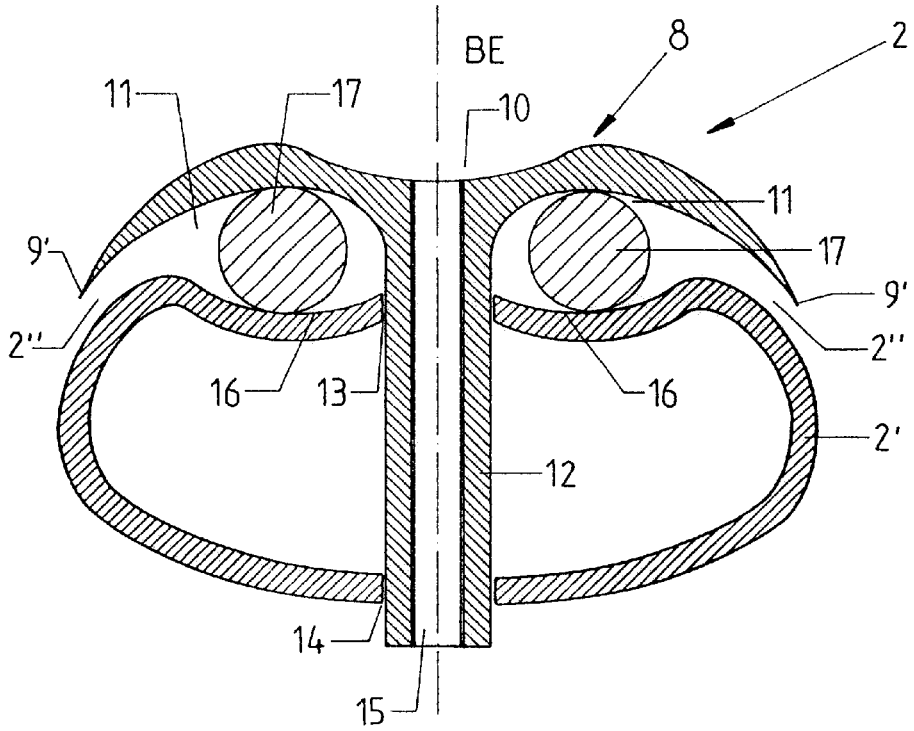
FIGS. 2 and 3 depict a cross section corresponding to line 1—1 of FIG. 1, before tensioning of the strings (FIG. 2) and after this tensioning (FIG. 3)
Figure 3:
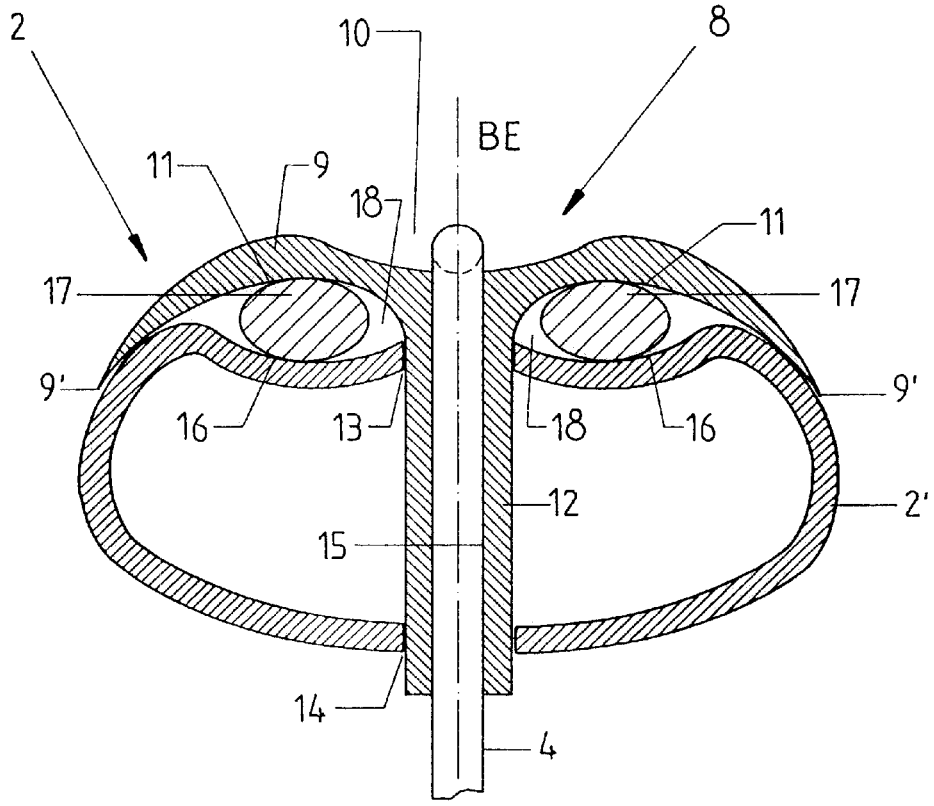

As shown in FIGS. 2 and 3, an outer force-buffering support profile 8 is provided for on the tension frame 2 or tension frame profile 2' that is on the outside in relation to the stringing 3, which in the depicted embodiment encompasses the tension frame 2 or the tension frame profile 2' along the entire long side of the tension frame 2 between the arms 5' of the core 5. The support profile 8, in the depicted embodiment, is symmetrical to the stringing plane BE and is a hood-like profile section 9 that is open toward the stringing 3, with a concave outer surface on its outer side facing away from the stringing 3 in the area of the stringing plane BE in the cross section view in FIGS. 2 and 3, in order to form a groove-like depression 10 that encloses the racket head or the tension frame 2 on the outside. On both sides of the depression 10, the profile section 9 in the sectional view of FIGS. 2 and 3 has an essentially convex bend on the outer surface, so that it forms two sections on both sides of the stringing plane BE that both form a concave depression 11 on the inner side facing the stringing 3 in the sectional view of FIGS. 2 and 3 that likewise extends along the entire length of the support profile 8 parallel to the depression 10. Furthermore, the support profile 11 has sleeves or eyelets 12 that are, for example, formed onto the side of the profile section 9 facing the frame 2' and extend beyond this side. The eyelets 12 are inserted through bore holes 13 and 14 of the frame profile 2', of which one bore hole 13 is arranged on the same axis as a bore hole 14 and the axes of which lie in the stringing plane BE. The eyelets 12 themselves have bore holes 15 through which the strings 3' are guided in the manner common to the stringing of tennis rackets that in a given direction the respective string 4 extends outward through the bore hole 15 of an eyelet 12, then within the depression 10 along the outer side of the tension frame and then through a further eyelet 12 or its bore hole 15 inward again etc. With the eyelets 12, the support profile 8 can be adjusted within certain limits in the direction of the axis of the eyelets 12 in relation to the frame profile 2'. The tension frame 2 is therefore made of two parts along at least part of its length. The support profile 8 is formed by one piece extending along the total periphery of frame 2.

As further shown in FIGS. 2 and 3, the profile 2' on the outer side facing the profile section 9 is constructed on both sides of the stringing plane BE and at a distance from this with a groove-like depression 16, each of which is located across from a depression 11. In each depression 16 and therefore also in the corresponding depression 11 and between the outer surface of the frame 2' and the inner surface of the supporting profile 8 or the profile section 9 there is an elastic element 17. In the depicted embodiment each element 17 extends along the entire length of the supporting profile 8. The elastic elements 17 are designed in such a way that when the supporting profile 8 is in a non-tensioned state and when the two outer edges 9' of the profile section 9 are at a distance from profile 2' (FIG. 2), and after stringing of the tennis racket 1, i.e. especially after stringing of the strings 4, the elastic elements 17 are pressed with an elastic or damping effect between the outer surface of the frame 2' and the inner surface of the supporting profile 8 in such a way that the supporting profile 8 bears closely against the outer surface of the profile 2' in the area of the edges 9', so that the space 18 formed between the outer surface of the frame 2' and the supporting profile 8 is closed, whereby however the tensile forces exerted by the stringing 3 or the strings 4 indicated by Arrow K in FIG. 3 are transferred across the supporting profile 8 and the elastic formed elements 17 onto the profile 2'. The elements 17 function not only as tension elements for maintaining the string tension, but also in particular as damping elements that provide an elastic damping of the impulse of a ball impacting on the stringing 3 or when striking the ball with the tennis racket 1, which in particular also prevents disturbing shocks, vibrations etc. in the frame of the tennis racket 1.

The elastic elements 17 can be, for example, of an elastic rubber material such as plastic, and are, e.g., corresponding lengths of a profile, for example a profile made of this material with a circular cross-section. The selection of material for the elements 17 is preferably such that it possesses not only elastic properties, but also damping or kinetic energy-consuming properties.

The elements 17 can also be hoses, for example, that are filled with a fluid, or with a gas or gas mixture, or with air or an inert gas (e.g. nitrogen or $CO_2$) and are tightly sealed. These hoses are then pressurized in the assembly state (FIG. 2), i.e. before tensioning the strings 4, with a certain pressure, or remain non-pressurized.

Special effects result when the elements 17 are filled with a liquid medium, for example with a medium containing oil and/or water, so that in this case the supporting profile 8 gives in for a short time inward toward the stringing 3 at the position where the maximum tensile force is exerted on the strings 4 when the ball hits the stringing 3, while in other non-affected or less affected areas of the stringing 3 the supporting profile 8 pressurizes across the elements 17 with an increased outward force due to the displaced liquid medium, causing an additional tension on the strings 4 here. This effect generally occurs when gas is used for filling. This results in completely new properties that are advantageous for a tennis racket 1.

In the above description, it was assumed that the elements 17 are all continuous elements. It is also possible to divide each of these elements into a number of individual elements, which are then connected to each other in the direction of the supporting profile 8 and are fixed to each other in a suitable manner for ease of assembly, for example.

Furthermore, it is possible for the elements 17 to be part of a general profile, for example of a profile in which the two elements 17 are connected together as profile sections across a cross bar, which is indicated in FIG. 2 by the broken line 19. Furthermore, it is possible for the elements 17 to be formed onto to the frame profile 2' or the supporting profile 8.

The supporting profile 8 must, as described above, be able to transfer the lateral forces K across the formed elements 17 to the frame. At the same time, however, the supporting profile 8 or its profile section 9 should still be sufficiently elastic at least in the area of the edges 9' that a damping inward movement of the supporting profile 8 is possible by distortion of the elements 17 upon impacts or impulses on the stringing 3. A suitable material for the supporting profile 8 would be a fiber-reinforced plastic material, metal or a composite material containing metal and plastic. In order to retain the required elasticity in the area of the edges 9', the profile section 9 is constructed there, for example, with a reduced thickness and/or the reinforcement of the profile section 9 necessary for the transfer of force ends at a sufficient distance from the edges 9'. There is a wide variety of imaginable solutions to this problem.

In the case of a supporting profile, in which the profile section 9 is made of metal, the eyelets 12 are preferably made of plastic and are inserted or formed into the corresponding openings of the profile section 9. In general, it is always possible to use a material for the eyelets 12, preferably a plastic material, that possesses a considerably higher degree of flexibility or elasticity in comparison with the profile section 9.

The eyelets 12 are, of course, designed in such a way that they tightly seal the interior of the frame 2' at the points of insertion or the bore holes 13 and 14.

As shown in FIGS. 2 and 3, the tension frame profile 2' forms slanted bearing surfaces 2" in the area of its outer sides, against which the profile section 9 of the supporting profile 8 bears in the area of the edges 9' and which in the sectional view of FIGS. 2 and 3 both lie in one plane that forms an angle smaller than 90° with the stringing axis BE, opening toward the stringing 3. This lessens the above-mentioned movement of the supporting profile 8 when the strings are tensioned relative to the tension frame profile 2' under elastic deformation of the profile section 9.

FIGS. 4 and 5 show as a further possible embodiment, a tennis racket in which the tension frame **2*a* again is designed in two parts, at least along part of its length, consisting of the actual, closed hollow frame 2*a'* and the supporting profile 8*a'* corresponding to the supporting profile 8**.

The essential difference of the embodiment in FIGS. 4 and 5, as compared with that depicted in FIGS. 2 and 3, is the fact that no bore holes 13 and 14 are implemented in the frame profile **2*a'*, but rather openings 20 extending from the outer side of the frame profile 2*a'* to the inner side of this frame profile and becoming larger in diameter toward the inner side of the frame profile 2*a'*, and which are closed by funnel-like wall sections 21 toward the interior of the frame profile 2*a'*. The supporting profile 8*a*, accordingly, has only relatively short eyelets 12*a* that each are inserted into an opening 20. Due to the openings that become larger at least in the cross-sectional axis perpendicular to the stringing plane BE, a lateral displacement of the corresponding string 4** during play is not possible, which for all practical purposes means an enlargement of the impact or stringing surface, among other things.

Figure 6:
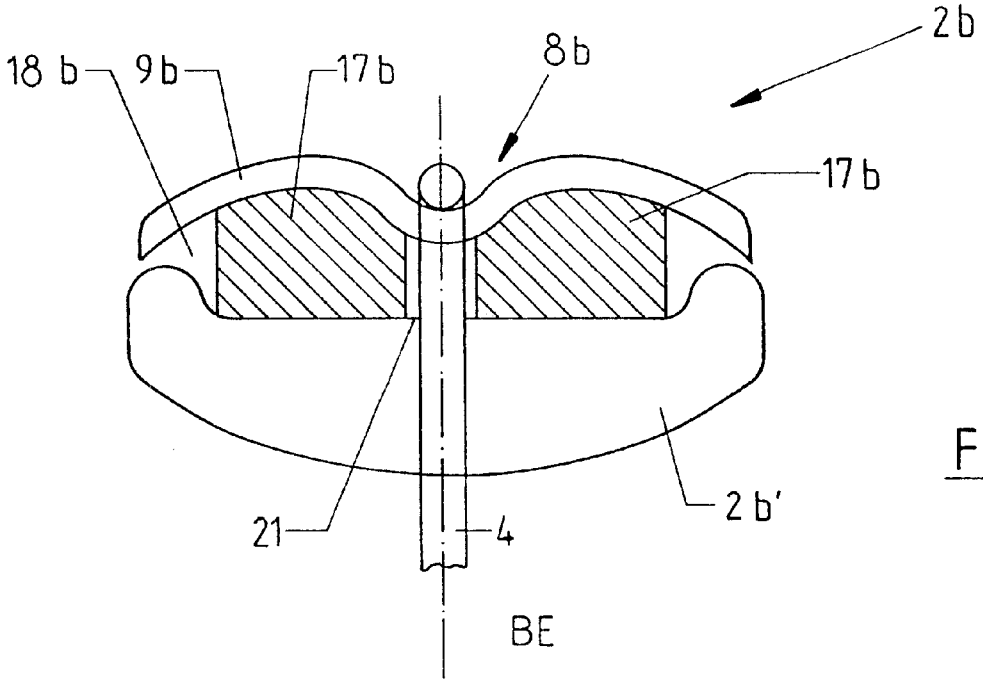
FIGS. 6 and 7 both depict a cross section through the racket head or tension frame of a ball racket according to the invention in an alternate embodiment.
Figure 7:
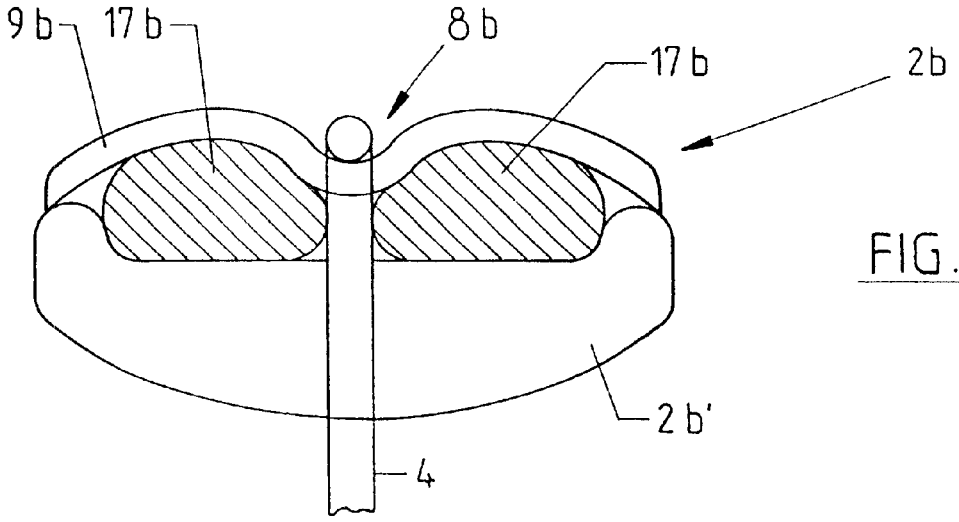

FIGS. 6 and 7 show in a representation similar to that of FIGS. 4 and 5 a cross-section through a tension frame **2*b* of a ball racket or tennis racket. The tension frame 2*b* has a frame profile 2*b'* corresponding to the frame profile 2*a'* and of the supporting profile 8*b*, the function of which corresponds to that of the supporting profile 8*a*. In the embodiment of FIGS. 6 and 7, instead of the flexible elements 17, a flexible element 17*b* is provided for between the tension frame profile 2*b'* and the supporting profile 8*b* or the wing-like profile sections 9*b* of this supporting profile on both sides of the stringing plane BE. Both elements have, for example, a rail-like design and extend around the entire circumference of the tension frame 2*b* on which (circumference) this tension frame has a two-part design, i.e. consisting of the frame profile 2*b'* and the supporting profile 8*b*. In the depicted embodiment the flexible elements 17*b*** are made of an elastomeric material, for example of an elastic, plastic or rubber.

A suitable shape of the elastic elements 17*b* and a suitable shape of the space 18*b* formed between the frame profile 2*b'* and the supporting profile 8*b*, occurs, when the strings 4 are under tension, the supporting profile 8*b* for fixing these strings on the tension frame 2 to be supported on the frame profile 2*b* when subjected to the elastic deformation of the elastic elements 17*b*, while a distance 21 remains between the elastic elements 17*b* and the strings, i.e. the elastic elements 17*b* do not touch the strings, as depicted in FIG. 6.

If extreme tensile forces are exerted on the stringing or on individual strings or string sections of this stringing when struck by a ball during play, then the resulting increased elastic deformation of the flexible elements 17*b* corresponding to FIG. 7 causes these elements 17*b* to bear against the strings 4, whereby with the increased load on the strings also the force increases with which the flexible elements 17*b* are pressed against them. The radial fixing of the strings 4 results, upon increased force, in a significantly better sound of the ball racket or of the tensioned frame during play and also an improved damping of vibrations of the strings 4, which also prevents or damps vibrations in the tension frame 2*b* excited by vibrations of the strings, thus significantly improving the overall vibration behavior of the racket or the racket frame.

In the above description it was assumed that the damping elements 17*b* are separate elements. It is generally also possible for these elements to be formed from a single rail-like element that possesses openings for lacing of the strings 4.

Figure 8:
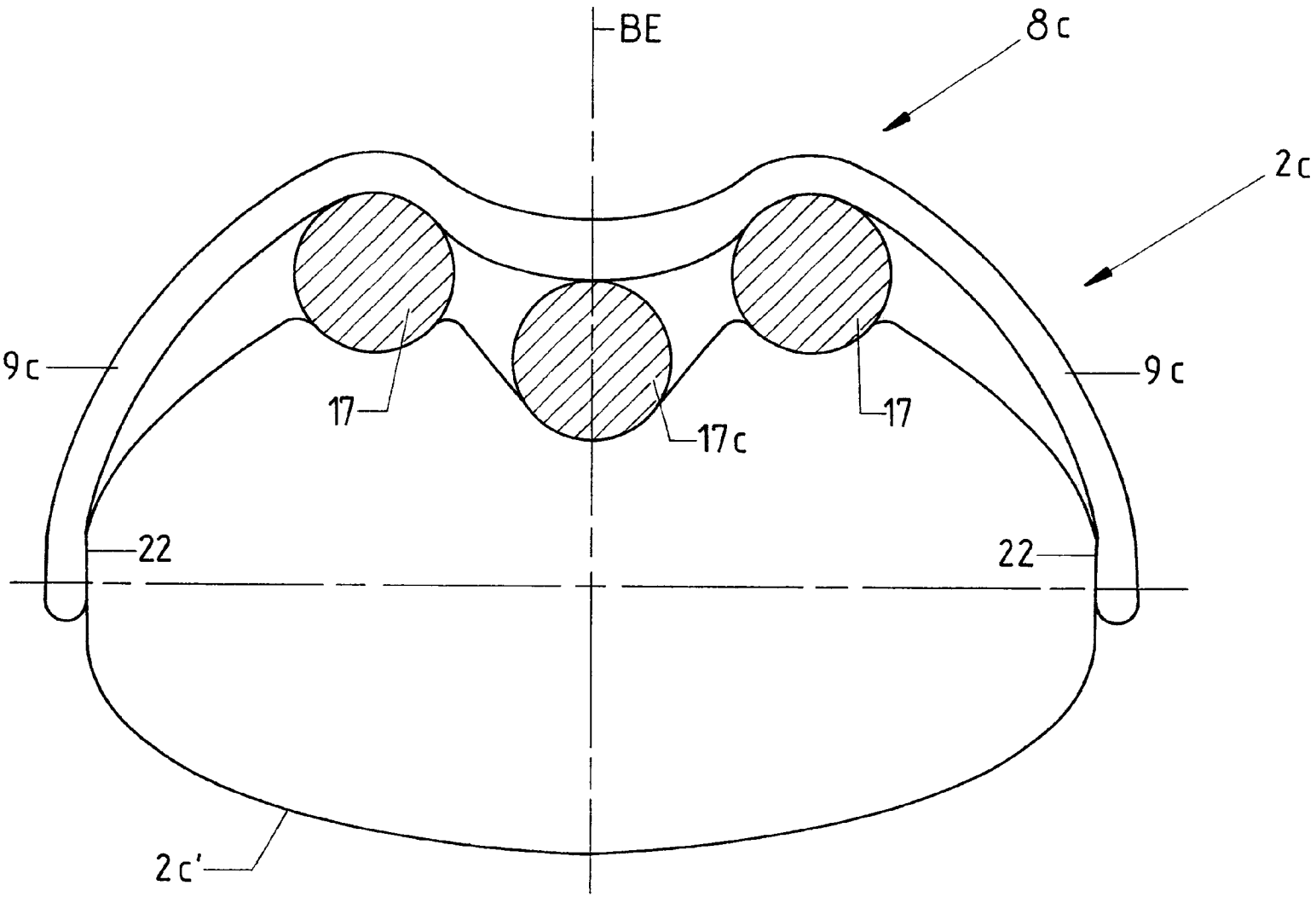
FIG. 8 depicts a cross section through the racket head or tension frame of a ball racket according to the invention in an alternate embodiment.

FIG. 8 shows in a representation similar to that of FIGS. 6 and 7 a cross-section through a tension frame 2*c* of a ball racket or tennis racket. The tension frame 2*c* consists of the frame profile 2*c'* corresponding to the frame profile 2*b'* and of the supporting profile 8*c*, the function of which is analogous to that of the supporting profile 8*b*. A flexible element 17 is provided for between the tension frame profile 2*c'* and the supporting profile 8*c* or the wing-like sections 9*c* of this supporting profile on both sides of the stringing plane BE. The supporting profile 8*c* is again formed by one piece extending along the total periphery of frame 2. The element 17 consists of a permanently elastic or elastomeric material, for example of an elastic or plastic, providing the required string tension due to its elasticity.

In the area of the stringing plane BE between the two elements 17, a further element 17*c* is provided for that is supported on the one hand against the inner side of the supporting profile 8*c* and on the other hand in the area of a groove-like depression on the tension frame profile 2*c* that is open toward the circumference of this tension frame profile 2*c*. The element 17*c*, which in the depicted embodiment in non-tensioned condition has, for example, a circular cross-section and extends along the entire length of the supporting profile 8*c*, is made of a material with damping properties, i.e. of a material that damps movements of the strings and also movements of the tension frame or of the tension frame elements, for example vibrations, impulses etc. The material of the element 17*c* is therefore such a material that is deformable, but expends kinetic energy upon being deformed.

As far as the element 17*c* is of a continuous design, this element contains openings for inserting the strings or the string eyelets. It is generally also possible for the element 17*c* to consist of several successive individual elements in the circumference direction of the tension frame 2*c*, which are then located between the string eyelets not depicted in FIG. 8.

The embodiment depicted in FIG. 8 therefore provides for the separation of the functional elements 17 for producing the string tension and the function element 17*c* for the damping of vibrations, impulses etc. Furthermore, as FIG. 8 shows, the frame profile 2*c* and the supporting profile 8*c* are designed in such a way that the free edges of the profile sections 9*c* overlap the frame profile 2*c* on the surfaces 22 that are parallel or roughly parallel to the stringing plane BE, so that a close outward seal of the space formed between the supporting profile 8*c* and the frame profile 2*c'* is guaranteed even with a relatively high degree of relative movement of the supporting profile 8*c* relative to the frame profile 2*c'* without deformation of the profile sections 9*c*.

Figure 9:
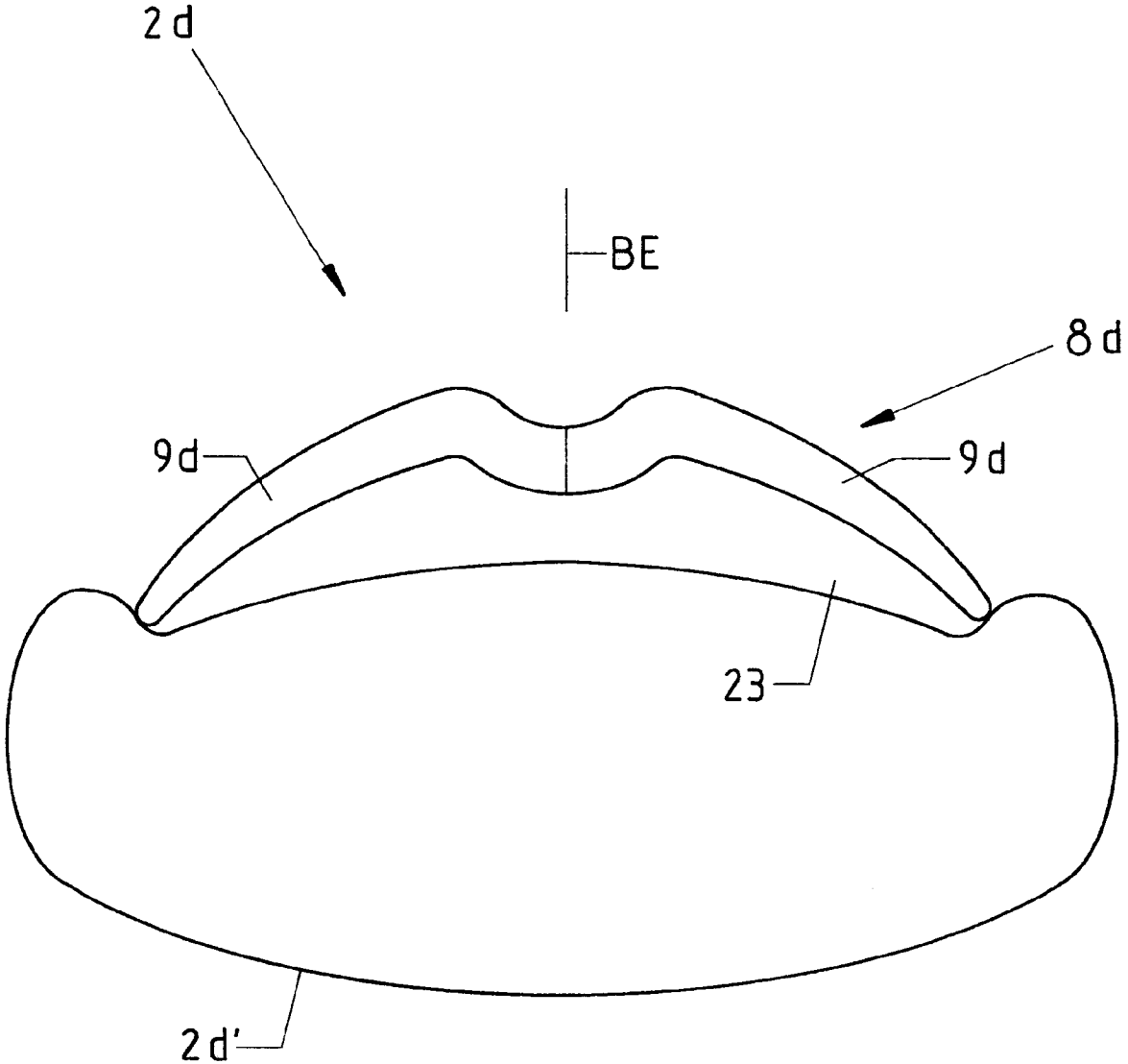
FIG. 9 is a simplified representation of a cross section through the racket head or tension frame of a ball racket according to the invention in an alternate embodiment.

FIG. 9 shows as a further possible embodiment a cross-section through a racket head or tension frame 2*d* of a ball racket or tennis racket. The tension frame 2*d* consists of the closed frame profile 2*d'* and of the supporting profile 8*d*, which in this embodiment is made of fiber-reinforced plastic, for example of fiberglass-reinforced plastic, in such a way that this supporting profile 8*d* or its wing-like sections 9*d* function as a spring, for example as a leaf spring. The support profile 8*d* is again formed by one piece extending along the total periphery of frame 2. The tension frame profile 2*d'* has on the outer side of the tension frame a groove-like depression 23 that extends at least over part of the fame profile 2*d'*, on which the leaf spring supporting profile 8*d* is located. In the free ends, the profile sections 9*d* are supported in the depression 23, so that the supporting profile 9*d* is secured against lateral displacement. The strings 4 of the stringing 3 are held in the middle of the supporting profile, for example by use of eyelets not depicted or an eyelet strip not depicted.

The embodiment in FIG. 9 differs from the embodiments of FIGS. 2–8 by the fact that the supporting element 8*d* made of fiber/composite material, e.g. of fiberglass composite material, is also designed as a spring element, so that the additional damping and tension elements are unnecessary.

The invention was described above using various exemplary embodiments. Of course, numerous modifications and adaptations are possible without abandoning the underlying inventive idea of the invention. For example, it is possible also in the area of the core 5 to construct the tension frame 2 or 2*a* in two parts in the manner illustrated in FIGS. 2 and 3 or 4 and 5, i.e. to provide for a supporting profile 8 to 8*d* there on the outer side facing away from the stringing 3. Furthermore, the frame profile and/or the supporting profile can, of course, have a design that deviates from the embodiments described above. The supporting elements can also made in sections joining each other along the periphery of the frame. In this case, the length of each section in the peripheral direction is larger than the width of the sections or the supporting element.

LIST OF REFERENCE TERMS

1 tennis racket
2, 2*a*, 2*b*, 2*c*, 2*d* tension frame
2', 2*a'*, 2*b'*, 2*c'*, frame profile
2*d'*
3 stringing
4 string
5 core
5', 5" arm
6 handle shaft
7 racket handle
8, 8*a*, 8*b*, 8*c*, 8*d* supporting profile
9, 9*b*, 9*c* , 9*d* profile section

10, 11 depression
12, 12*a* eyelet
13, 14 bore hole
15 bore hole
16 depression
17, 17*b*, 17*c* flexible and/or damping element
18, 18*b*, 18*c* space
19 cross bar
20 opening
21 opening or slit
22 surface
23 recess
BE stringing plane

What is claimed is:

1. A ball racket having a racket head formed by a tension frame with stringing defining a stringing plane and a handle element connected to the tension frame by a core which is formed by a handle shaft and a handle, whereby the tension frame comprises two parts in at least part of the racket head, the two parts being a tension frame profile adjacent to the stringing and a supporting frame profile that is located in an outside in relation to the stringing, on which strings forming the stringing are held and which is pre-tensioned relative to the tension frame profile for the purpose of tensioning the strings, wherein the tension frame profile is a hollow profile closed on its total perimeter, the supporting profile has two wing like profile sections extending away from a middle line of the supporting profile and the stringing plane in opposite directions, the supporting profile has, along the middle line: a plurality of eyelets, or bare holes for the strings of the stringing; at least one damping or a tension element in a space formed between the supporting profile and the tension frame profile and acting between the profiles, each supporting profile sections forming a free end, and resting with the free tightly against an outer surface of the closed perimeter of the tension frame profile and thereby closing the space to the outside, wherein the at least one damping and/or tension element is a lumen filled with a liquid, gas or vapor.

2. The ball racket according to claim 1, wherein the at least one damping and/or tension element is formed by at least one body made of an elastic material.

3. The ball racket according to claim 1, further comprising on both sides of the stringing plane formed by the stringing, at least one damping and/or tension element.

4. The ball racket according to claim 2, wherein the at least one damping and/or tension element is formed by a length of a profile from an elastic material.

5. The ball racket according to claim 1, wherein the lumen forms a tightly sealed space that is closed to an exterior.

6. The ball racket according to claim 1, wherein the supporting profile, in order to form a closed space, bears against the tension frame profile with edges at a distance from the stringing plane in a damping and/or sliding manner, so that a movement of the supporting profile relative to the tension frame profile is possible in axis directions within the stringing plane.

7. The ball racket according to claim 1, wherein supporting profile eyelets and/or corresponding bore holes are provided for the strings of the stringing.

8. The ball racket according claim 7, wherein the supporting profile eyelets extend from an outer side of the tension frame profile through openings of the tension frame profile to an inner side of the tension frame profile.

9. The ball racket according to claim 1, further comprising tension frame profile openings provided for insertion of the strings, which are sealed by wall sections enclosing the openings to an interior of the tension frame profile.

10. The ball racket according to claim 1, further comprising supporting profile eyelets for the strings that extend into an opening of the tension frame profile.

11. The ball racket according to claim 1, wherein the supporting profile, at least in an area extending between the respective string and the damping and/or tension element, is manufactured of a material or composite material suitable for the transfer of forces.

12. The ball racket according to claim 1, wherein the supporting profile is made of a fiber-reinforced plastic, a metal or a metal-plastic composite.

13. The ball racket according to claim 1, wherein the damping and/or tension element between the supporting profile and the frame profile is formed in such a way that a radial pressure against at least part of the strings forming the stringing increases with an increase in elastic deformation.

14. The ball racket according to claim 13, wherein the damping or tension element is at a distance from the strings up to a pre-defined degree of an elastic deformation.

15. The ball racket according to claim 1, wherein between the frame profile and the supporting profile, there is provided tension elements and at least one damping element that is physically and/or spatially separated from these.

16. A ball racket with a racket head formed by a tension frame with stringing defining a stringing plane, the racket having a handle element which is connected to the tension frame by a core formed by a handle shaft and which forms a handle, the tension frame comprising two parts in at least part of the racket head, the two parts being a tension frame profile adjacent to the stringing, said tension frame profile being a hollow profile closed on its total perimeter, and a support frame profile that is located in an outside in relation to the stringing and on which strings forming the stringing are held, the supporting profile being designed as a leaf spring pre-tensioned relative to the tension frame profile for tensioning the strings and having two wing like profile sections extending away from a middle line of the supporting profile in opposite directions, the middle line laying in the stringing plane, each profile section forming a free end which is supported by the closed perimeter of the tension frame profile, and the supporting profile being provided along the middle line with a plurality of eyelets or bore holes for the strings of the stringing.

17. The ball racket according to claim 16 wherein the supporting profile is made of a fiber-reinforced plastic material.

18. The ball racket according to claim 16, wherein the tension frame profile is provided on the outer side with a groove-like depression that extends at least over a part of the head frame profile, and wherein free ends of the profile sections of the supporting profile are supported in the depression.

19. The a ball racket according to claim 16, wherein the support profile extends along a total periphery of the head frame.

* * * * *